US005165568A

United States Patent [19]

Wischusen, III

[11] Patent Number: 5,165,568

[45] Date of Patent: Nov. 24, 1992

[54] CONTAINER WITH EXTERNAL RESEALING BAG

[75] Inventor: Henry Wischusen, III, Lilburn, Ga.

[73] Assignee: Rock-Tenn Company, Norcross, Ga.

[21] Appl. No.: 800,035

[22] Filed: Nov. 29, 1991

[51] Int. Cl.[5] ..... B65D 65/22

[52] U.S. Cl. ..... 220/461; 53/381.1; 229/87.01; 383/119; 493/89; 493/111

[58] Field of Search ..... 229/87.01; 220/416, 220/418, 460, 461, 462; 383/119; 493/89, 111, 112, 113, 121, 183; 53/381 R, 382

[56] References Cited

U.S. PATENT DOCUMENTS

| | | | |
|---|---|---|---|
| 1,264,497 | 4/1918 | Field . | |
| 2,008,420 | 7/1935 | Howard . | |
| 2,556,321 | 6/1951 | Denton . | |
| 3,542,281 | 11/1970 | Field et al. | 383/119 |
| 3,549,083 | 12/1970 | Canno et al. | 383/119 |
| 4,032,060 | 6/1977 | Bergstein . | |
| 4,064,302 | 12/1977 | Kozlowski et al. | 383/119 |
| 4,575,000 | 3/1986 | Gordon et al. | 229/87 F |
| 4,622,693 | 11/1986 | Mykleby | 383/119 |
| 4,720,015 | 1/1988 | Brauner | 220/461 |
| 4,723,700 | 2/1988 | Wischusen, III | 229/120 |
| 4,754,914 | 7/1988 | Wischusen, III | 220/403 |
| 4,779,998 | 10/1988 | Wischusen, III | 383/121 |

FOREIGN PATENT DOCUMENTS

| | | | |
|---|---|---|---|
| 1239813 | 7/1960 | France | 220/461 |
| 545113 | 5/1942 | United Kingdom | 229/87.01 |

*Primary Examiner*—Gary E. Elkins

*Attorney, Agent, or Firm*—Jones, Askew & Lunsford

[57] ABSTRACT

An automatically resealing container is provided, consisting of an interior paperboard box and an external resealing bag of flexible plastic film. The film is associated with closure flaps of the box such that when the flaps are reclosed, the film is pressed together outside the box to provide a nearly airtight seal. The single external film bag provides the dual function of protecting the contents as well as the exterior of the box.

12 Claims, 5 Drawing Sheets

CONTAINER WITH EXTERNAL RESEALING BAG

TECHNICAL FIELD

The present invention relates to containers for holding perishable goods which are dispensed periodically from the container, such as breakfast cereal, and more particularly relates to a paperboard box covered on its exterior by a plastic film which automatically reseals the container when paperboard closure flaps are engaged to close the container.

BACKGROUND ART

Many food products are perishable and also fragile, that is, subject to becoming crushed or pulverized if subjected to trauma. Such products include, for example, breakfast cereal, candies, and snack foods. Breakfast cereal has traditionally been shipped to the consumer in paperboard boxes having a resealable bag liner made of waxed paper, plastic film, or metal foil. The box protects the contents against being crushed, and the liner is impermeable to moisture and moist outside air that could make the product turn stale.

Many problems and inefficiencies with such conventional packages have been tolerated by the industry. The outer paperboard box is subject to degradation if it becomes wet, and even though the contents may remain dry within the inner bag, the box may lose its structural integrity and fail to protect the product against crushing. The outer paperboard box is also subject to infestation by pests. Graphics printed on the box exterior are also subject to degradation as a result of moisture or abrasive handling.

Manufacturers may resort to forming the box from specially treated waterproof board. This practice significantly increases the cost of the container, as it results in two separate sealing envelopes, one inside and one outside the box. Consumers have been known to provide a second, outer seal by placing the box after opening into a sealable plastic bag.

Conventional cereal containers of the type described require multiple-step loading and closing procedures. One option is to insert the inner bag into the box, hold open the bag while filling it, seal the bag within the box, and finally glue the paperboard top closure panels. Holding a flimsy bag open within the box is difficult, and the equipment using this technique is slow. Another option is to fill the bag and seal it, then drop the bag into the box and seal the closure panels. This requires handling of the non-rigid bag with its unprotected fragile contents, which can lead to crushing of some of the product. It is a difficult and slow process to fit a non-shaped bag into a square box having the same volume, so the full bag must be smaller than the box. Thus, the capacity of the box is underutilized.

When the consumer is ready to open the container, the closure panels are separated and the top of the inner bag is opened. The bag may be formed by creating fin seals along the bottom and top of a tubular length of the film used to make the bag. For reclosing, two steps are required. Conventional containers are typically provided with closure panels having a slit in one panel and a tuck tab in the other panel. The consumer folds or rolls the bag to reclose it, often forming an imperfect seal. Then he or she closes the box panels and inserts the tuck tab into the slit.

Thus, there is a need in the art for a container for perishable, fragile products which is easy to load rapidly, protects the exterior of the paperboard box, avoids duplicating the sealing function, and closes and reseals the container in a single step.

SUMMARY OF THE INVENTION

The present invention provides an improved resealing container which avoids the problems associated with conventional containers having an internal sealed bag. A container embodying the invention utilizes a film sealing closure, attached to the outside of a box portion of the container, to seal and reseal a container opening.

Generally described, the present invention provides a resealing container, comprising a sleeve wall portion defining a top opening; a plurality of closure flaps foldably connected to the sleeve wall portion at the top opening; the closure flaps enclosing the top opening when folded across the top opening; means for releasably securing the closure flaps together; and a flexible film extending from the exterior of the sleeve wall portion and surrounding the top opening, with portions of the film being attached to and movable with the closure flaps; such portions of the film engaging each other upon reclosure of the container so as to seal the top opening when the securing means is securing the closure flaps together.

In a preferred embodiment, two closure flaps overlap when folded across the top opening, and the securing means comprises a lock opening defined in the first closure flap and a tuck tab extending from an edge of the second closure flap and positioned to be inserted into the lock opening. A pair of dust flaps may be foldably attached to the sleeve wall portion, positioned opposite one another between the closure flaps. Optionally, the dust flaps may be attached to the film. Upon reclosure, the film may be tucked in with the dust flaps and across the lock opening, so that when the tuck tab is snapped into the lock opening, it deforms the film into the lock opening. This provides a still better seal.

The present invention also provides a method for sealing and resealing a container having a sleeve wall portion defining a top opening and closure flaps connected to the sleeve wall portion at the top opening, comprising the steps of attaching a flexible film to the exterior of the sleeve wall portion so as to extend from the sleeve wall portion and surround the top opening; attaching the film to the closure flaps at selected locations with portions of the film extending from the locations away from the closure flaps; sealing the film portions to enclose the top opening; opening the sealed film portions and the closure flaps; and reclosing the closure flaps so as to bring the extending portions of the film into engagement with one another.

Thus, it is an object of the present invention to provide an improved sealed container.

It is a further object of the present invention to provide an improved recloseable container which automatically reseals upon reclosing.

It is a further object of the present invention to provide a container for perishable, fragile products which provides a sealed film It is a further object of the present invention to provide a container which seals its contents and is also easy to load.

It is a further object of the present invention to provide a container which seals both the contents and the exterior surface of a paperboard box with a single sealing barrier that is resealable.

It is a further object of the present invention to provide an improved method of sealing and resealing a container.

Other objects, features and advantages of the present invention will become apparent upon review of the following detailed description of a preferred embodiment, when taken in conjunction with the appended drawings.

DETAILED DESCRIPTION

Figure 1:
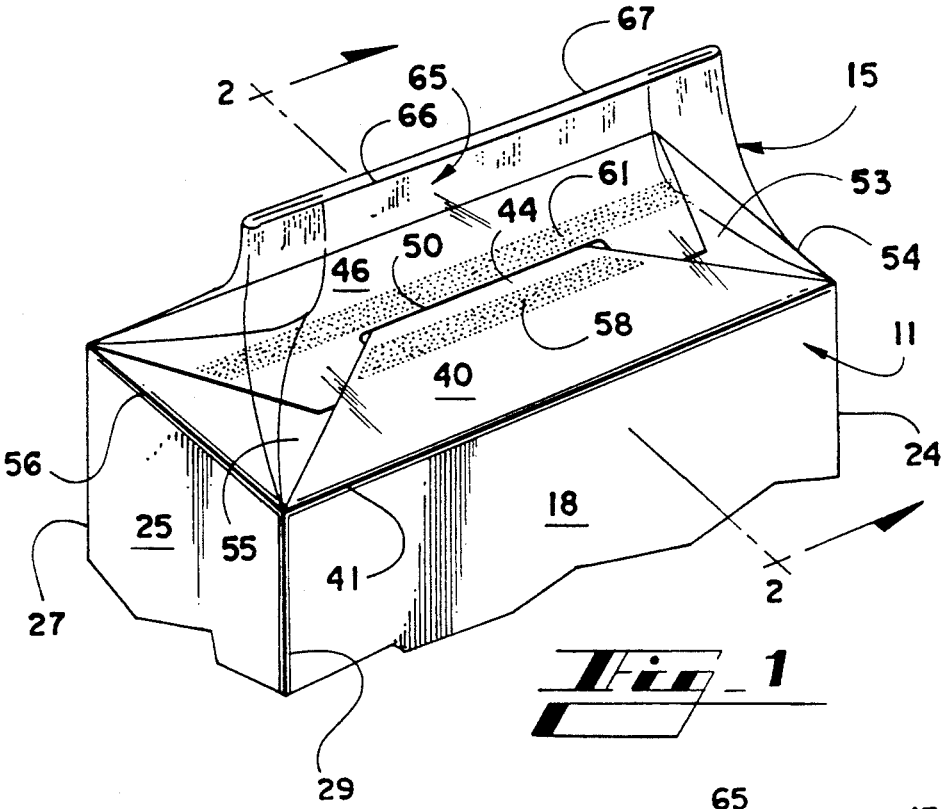
FIG. 1 is a top pictorial view of the top portion of a container embodying the present invention in a factory-closed configuration.

Referring now in detail to the drawings, in which like numerals refer to like parts throughout the several views, FIG. 1 shows a reclosable container 10 embodying the present invention. The container 10 includes an interior semi-rigid box portion 11 formed of a foldable material, such as paperboard. The inner paperboard portion is formed from a flat blank 12, shown in FIG. 3. A flexible film 15, shown as being transparent, is wrapped around the paperboard box and extends upwardly above the top of the box. As shown in FIG. 1, a conventional gusseted fin seal 65 is utilized to close the film sleeve above the top of the box 11 prior to use.

Figure 3:
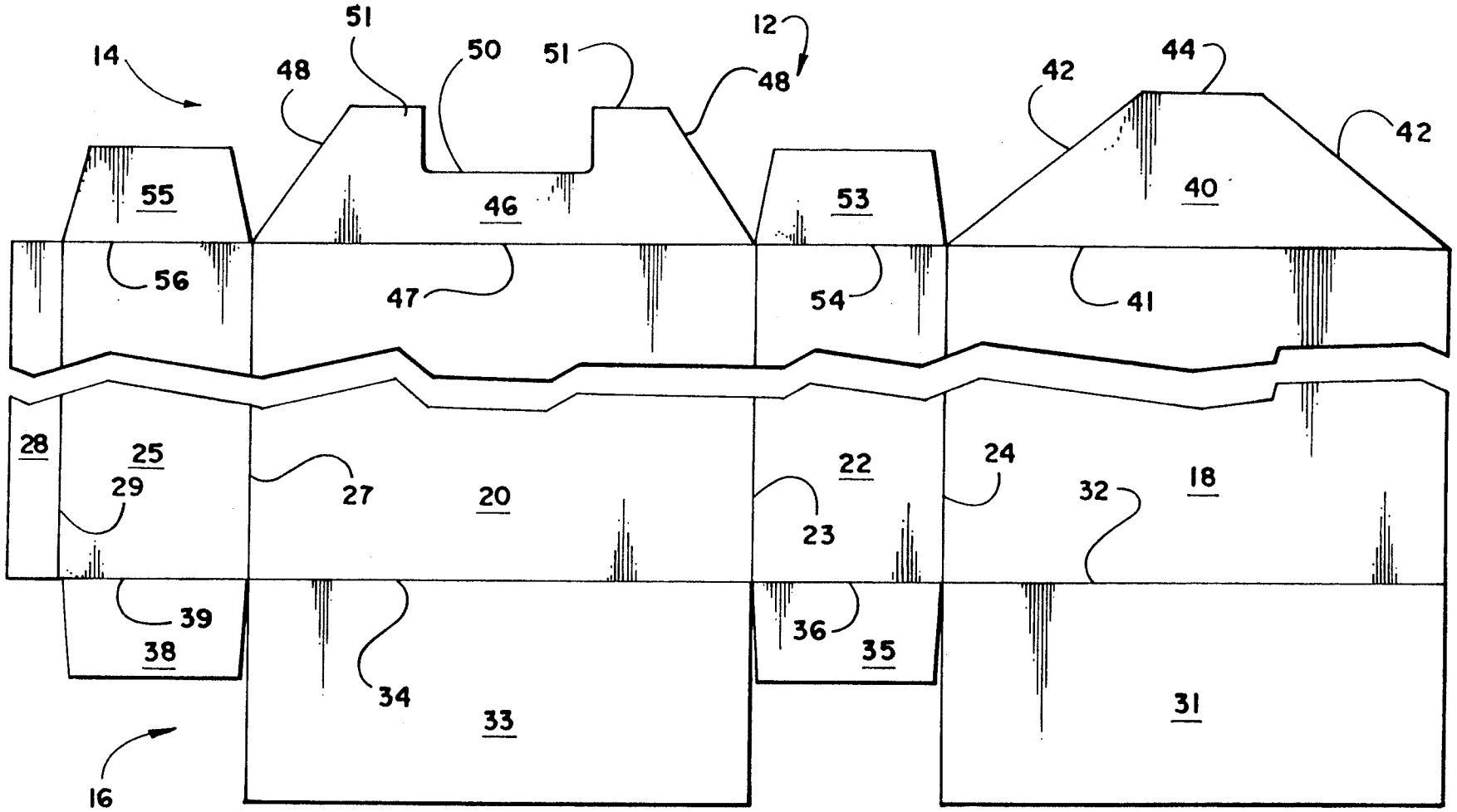
FIG. 3 is a plan view of a blank of paperboard or the like utilized in forming the container of FIG. 1.

The paperboard blank 12, the interior side of which is shown in FIG. 3, is scored and cut using conventional procedures to form various panels separated by fold lines or score lines. The box 11 preferably defines a rectangular sleeve having end panels which form a top closure 14 and other end panels which may form a bottom closure 16. The rectangular sleeve includes a front panel 18 and a spaced apart parallel back panel 20. A side panel 22 is connected to the back panel 20 along a score line 23, and also is connected to the front panel 18 along a score line 24. A second side panel 25 is connected to the back panel 20 along the score line 27, and also is connected to a glue flap 28 along the score line 29, which extends along the opposite edge of the side panel 25 from the score line 27.

It should be understood that the sleeve portion of the box 11 may be formed to have various non-rectangular cross sections.

The bottom closure 16 may be formed from a pair of bottom closure flaps and associated dust flaps. A bottom closure flap 31 is foldably connected to the front panel 18 along a score line 32. A second bottom closure flap 33 is connected to the back panel 20 along the score line 34. A dust flap 35 is connected to the side panel 22 along the score line 36, and a second dust flap 38 is connected to the side wall 25 along a score line 39.

The top closure 14 includes a top closure flap 40 foldably connected to the front panel 18 along a score line 41. Whereas the bottom closure flap 31 is preferably rectangular in shape, the top closure flap 40 defines angular beveled edges 42 which extend from the top corners of the front panel 18 to the outer edge of the top closure flap 40, defining a tuck flap 44 at the outer edge of the flap 40. A second top closure flap 46 is foldably connected along the score line 47 to the back panel 20. The flap 46 also defines angled edges 48 which extend from the top corners of the panel 20 to the outermost edge of the flap 46. However, the angle between the edges 48 and the score 47 is larger than the angle between the edges 42 and the score line 41. In the preferred embodiment as best shown in FIG. 3, in which the width of the front panel is about 2.5 times greater than the depth of the side panels, the angle between an edge 42 and the score 41 is preferably about 40 degrees, while the angle between the edge 48 and the score 47 is preferably about 60 degrees. If the width-to-depth ratio is reduced to 1.5, the angles would preferably be about 50 degrees and 70 degrees, respectively.

A cutout lock opening 50 is removed from the flap 46, and preferably consists of a rectangular opening extending from the outermost edge of the flap 46 inwardly toward the score line 47 for approximately one half the width of a flap 46. The depth of the lock opening 50 as well as its length are selected so that when the flap 46 is closed across the top opening of the sleeve and the flap 40 is similarly closed onto the flap 46, the tuck flap 44 may be snapped into the lock opening 50 where it will be trapped in a conventional manner by corners 51 of the flap 46 to maintain the flaps 40 and 46 in a closed position over the sleeve. As is well known in the art, dust flaps 53 and 55 may be folded across the sleeve top opening prior to the closure of the main closure flaps 40 and 46. Alternately, a slit or a slot for receiving the tab 44 may be substituted for the lock opening 50.

From the foregoing description, it will be seen that the box 11 may be formed in a conventional manner from the blank 12 shown in FIG. 3. By applying glue to the glue flap 28 and making appropriate folds about the score lines 24 and 27, the front panel 18 may be secured to the glue flap 28. The box may be stored or shipped in the resulting flat configuration. Subsequently, the sleeve may be erected by placing inward pressure on the score lines 24 and 27. Then the conventional bottom closure may be formed by folding in the dust flaps 35 and 38 and folding in the bottom closure flaps 31 and 33 with glue applied between them. While the manner of locking the tuck flap 44 into the lock opening 50 is well known, the association of the film 15 with the top closure flaps as will now be described in detail provides an advantageous resealable closure that is the subject of the present invention.

Figure 2:
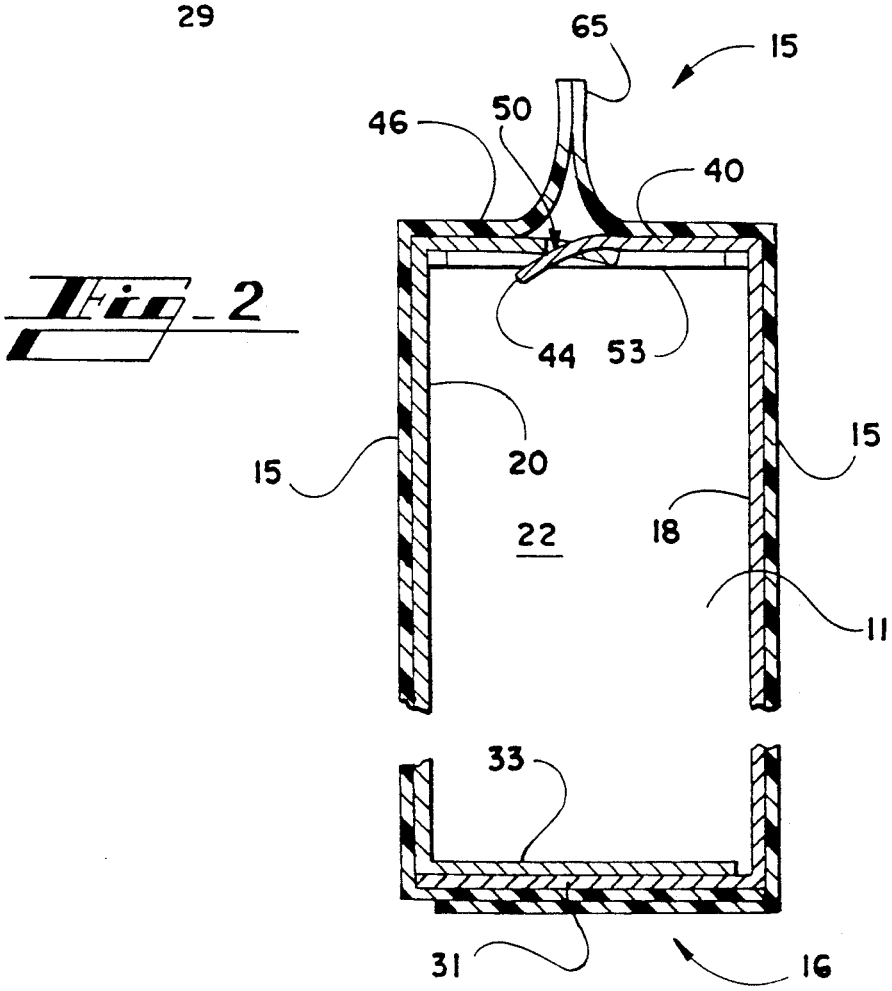
FIG. 2 is a vertical cross section of the container shown in FIG. 1, taken along line 2—2 of FIG. 1.

After the inner box portion of the container is formed with an enclosed bottom, the container may be filled with a product. The relative rigidity of the paperboard material will protect the contents from being crushed. Since no inner bag is provided within the paperboard box, more of the interior volume may be filled with product. After filling, the top closure 14 is initially secured by folding in the dust flaps 53 and 55, folding the lower top closure flap 46 onto the dust flaps, and then folding the upper top closure flap 40 into contact with the lower closure flap 46, which the upper closure flap 40 partially overlaps. This folding operation can be accomplished by automatic machinery, which presses the top closure flaps 46 and 40 into their closed position with the tuck tab 44 snapped into the lock opening 50, as shown in FIG. 2. Alternately, the machinery may provide glue spots (not shown) to secure the top closure 14 in its closed position for shipment.

Figure 4:
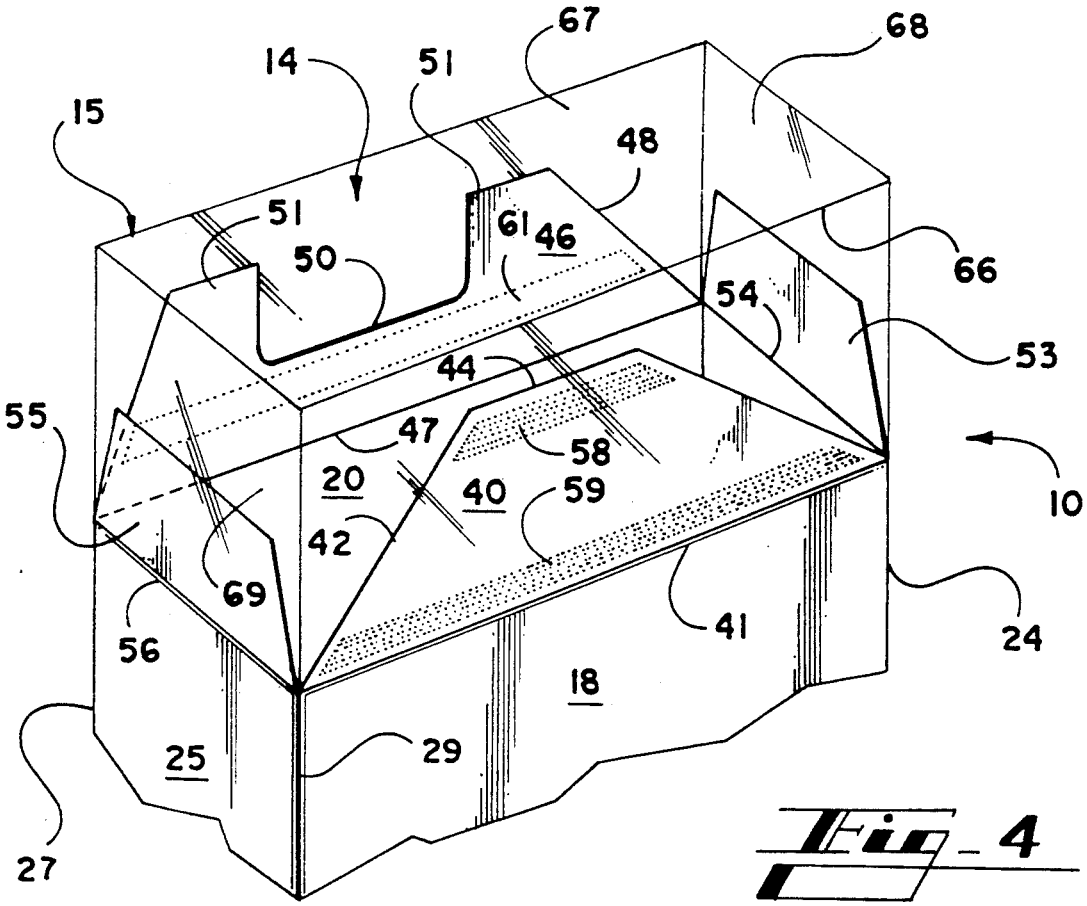
FIG. 4 is a top pictorial view of the container of FIG. 1, showing the container in a open configuration for removal of its contents.

Thereafter, the film 15 may be applied to the exterior of the box. A flat sheet of film may be wrapped around the front, back and sides panels of the box and secured in position by adhesive or known welding techniques to form a sleeve. The sleeve is dimensioned to extend below the enclosed bottom of the box so that it can be tucked and folded against the bottom of the box and sealed, as shown in FIG. 2. This sealing may be accomplished by adhesive or by welding. The upper portion of the film sleeve is dimensioned to extend beyond the top closure flaps 40 and 46, as shown in FIG. 4. It should be understood that the reclosable top closure 14 may be formed using flexible film which extends from a peripheral portion of the front, back, and side panels as shown in FIG. 4, without covering the entire outside of the box, if desired. The flexible film 15 is preferably a transparent plastic film, as shown, preferably a multilayer, heat-sealable polypropylene or polyester having an outer heat-sealable layer and other layers selected for strength, flexibility and tear resistance. However, various plastic films may be used, as well as wax paper or film metallized by vacuum deposition of a metal, such as aluminum.

After loading and closing of the top closure flaps, lines of adhesive 58 and 59 are placed on the top closure flap 40 adjacent to the tuck tab 44 and adjacent to the score line 41. Similar glue strips 61 and 62 are applied to the lower top closure flap 46 adjacent to the lock opening 50 and adjacent to the score 47. The upwardly extending portion of the flexible film 15 may be bought together above the top closure 14 to form a conventional gusseted fin seal 65 by bringing upper peripheral portions 66 and 67 of the film sleeve which extend above the front panel 18 and the back panel 20, respectively, together and joining them by the use of adhesive or heat welding. During the formation of the fin seal 65, the plastic film is pressed onto the top closure 14 so that the film adheres to the glue strips 58, 59, 61 and 62.

Those skilled in the art will understand that it is alternately possible to form the container as shown in FIG. 4 with the film adhered to the outside of the blank 12 and to the glue strips 58, 59, 61 and 62, before the container is filled. In this case, after filling, the dust flaps 53 and 55 are folded inwardly, and the closure of the flaps 40 and 46 brings the top portion of the film 15 into position for creation of the fin seal 65.

Figure 8:
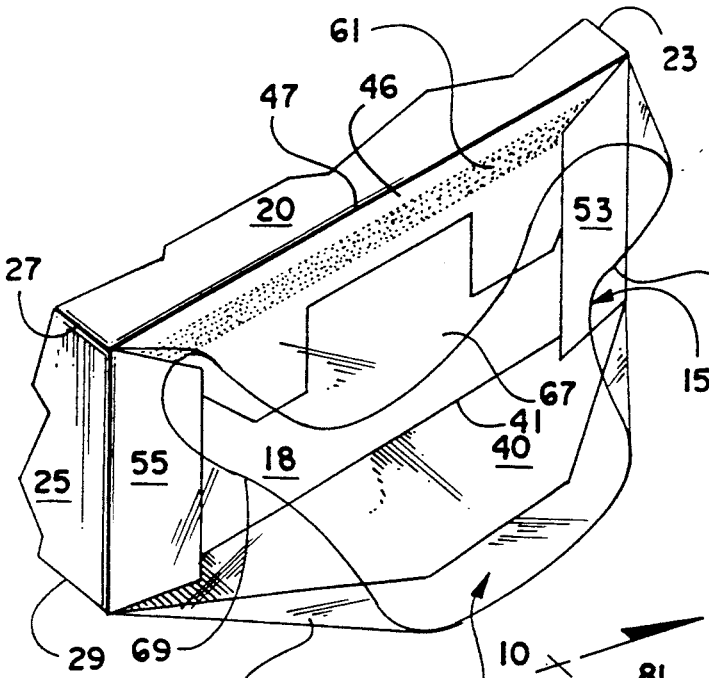
FIG. 8 is a pictorial view of the open container showing formation of a funnelling spout.

During shipping of the sealed container 10, the area of the film 15 forming the fin seal 65 can be pressed against the box and will take up no more space in shipment than the box itself. When the container has been purchased by a consumer who desires to gain access to the contents, the fin seal may be separated in the usual manner by grasping the two opposing film areas 66 and 67 and pulling outwardly. This is particularly easy for the consumer to accomplish if the fin seal 65 is made utilizing a cohesive, a pressure sensitive adhesive, or a "Zip-Lok TM" closure. Upon opening the fin seal, the consumer lifts the top closure flap 40 and pulls it upwardly to separate it from the other top closure flap 46 and pulls the two top closure flaps apart. Advantageously, the consumer may rotate the flap 40 outwardly about the score 41 to a position beyond the plane of the front panel 18. This pulls the flap 46 somewhat inwardly so that the dust flaps may be lifted to catch on the edges 48 of the flap 46, thus clearing the opening. As shown in FIG. 8, this action also causes the flap 40 and the portion 66 of the film 15 to form a funnelling spout 80 through which the contents may be poured from the box.

Figure 5:
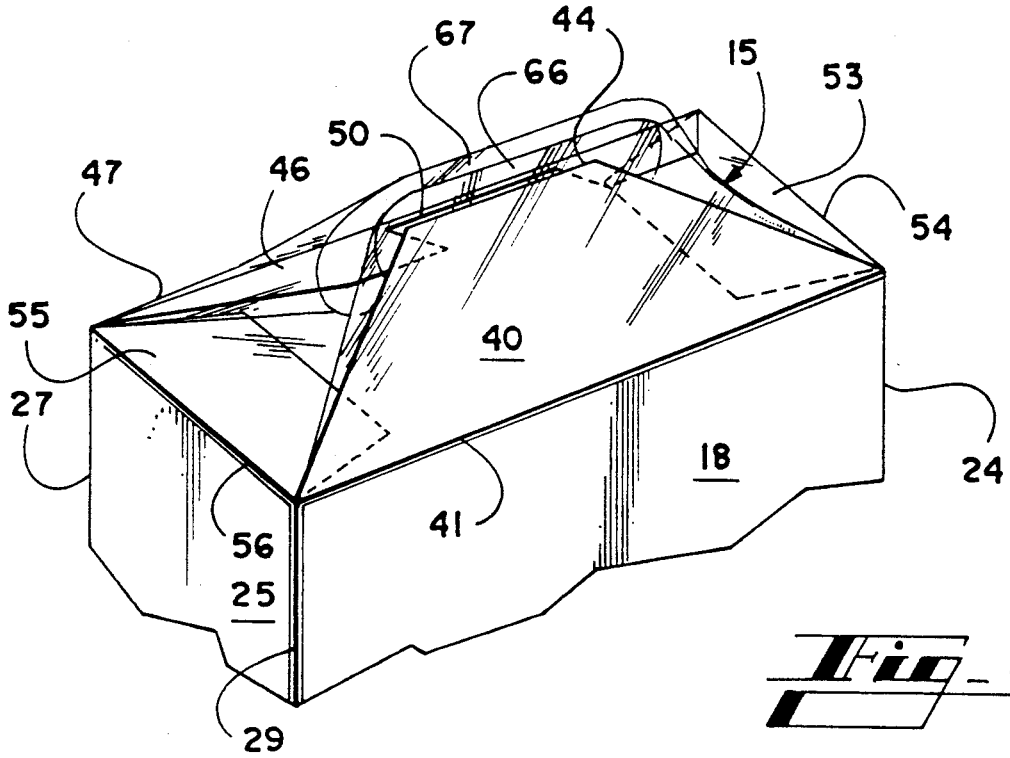
FIG. 5 is a top pictorial view of the container of FIGS. 1 and 4 in a partial reclosed configuration.
Figure 6:
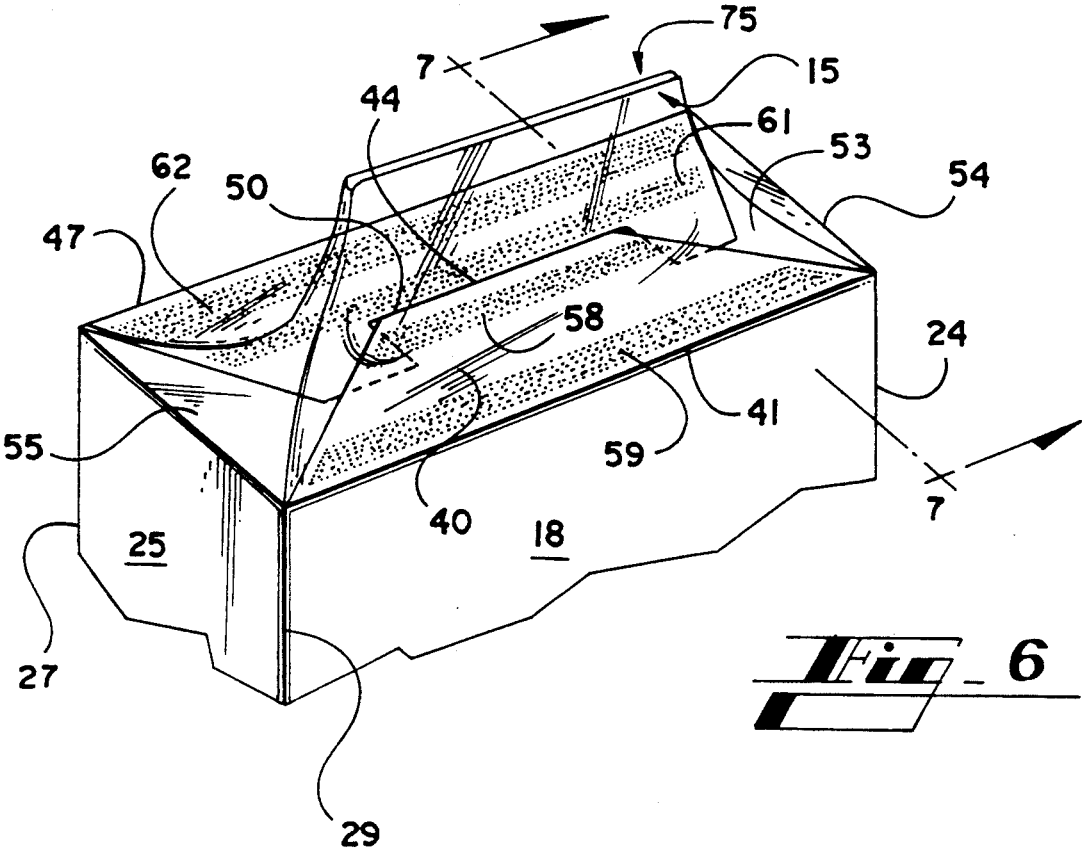
FIG. 6 is a top pictorial view of the container of FIGS. 1, 4 and 5 in a fully reclosed configuration.

When the consumer desires to reclose the container 10, the consumer may pull up on the flap 46, releasing the dust flaps 53 and 55 from the edges 48. Then the dust flaps 53 and 55 and upwardly extending side portions 68 and 69 of the film sleeve are folded together over the top of the container 10, automatically gusseting the film 15. Then the top closure flaps 46 and 40 are folded inwardly and downwardly, with portions of the film tucked under flap 46 under the flap 40. According to one embodiment of the top closure according to the invention, the tuck tab 44 of the flap 40 begins to be inserted between the upper surface of the flap 46 and the extending portion 67 of the film sleeve as the flaps are lowered, as shown in FIG. 5. As shown in FIG. 6, when the flap 40 reaches a horizontal position resting on top of the flap 46, a small amount of additional pressure will snap the tuck tab 44 into the opening 50. The closure flap 40 is thus resting on the corner portions 51 of the flap 46 with the tuck tab portion 44 extending under the flap 46. This locking mechanism prevents the closure flaps 40 and 46 from opening again until an upward force is exerted by the consumer.

Figure 7:
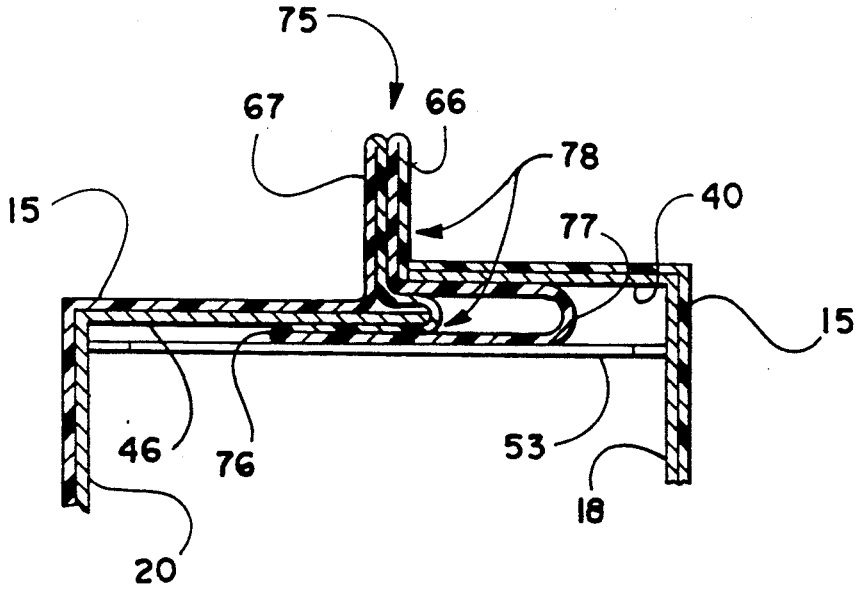
FIG. 7 is a vertical cross sectional view of the configuration of FIG. 6, taken along line 7—7 of FIG. 6.

While the closure flaps are being manipulated, the upper portion of the film sleeve reaches a final configuration as shown in FIG. 6 and FIG. 7. The upper portions 66 and 67 of the film have been forced together to form an upstanding exterior sealing area 75 above the box portion of the container. Moreover, the film material has been folded and presses against itself where the film is tucked between the closure flaps 40 and 46, and the dust flaps 53 and 55. FIG. 7 is a cross sectional view taken along a transverse line between the lock opening 50 and the dust flap 53. It can be seen that the flexible film forms an interior fold 76 between the lower closure flap 46 and the dust flap 53, and another interior fold 77 between the upper closure flap 40 and the dust flap 53. The exterior sealing area 75 extends downwardly to connect with a sealing area 78 in which the film layers are pinched together as they bend around corners and are pressed together between the flap 40 and the flap 46, which are held by the locking of the tuck tab 44 into the opening 50.

It will thus be seen that the extending portions of the flexible film 15 automatically form a nearly air tight seal when the top closure flaps are folded inwardly to reclose the container 10. If cohesive or pressure sensitive adhesive is provided on facing surfaces of the film portions 66 and 67, they will adhere on contact or upon the application of pressure by the consumer. Furthermore, the container 10 may be reopened and reclosed, as just described, as many times as necessary until the contents of the container are completely dispensed.

When tucking in the film areas 68 and 69, the angled edges 42 and 48 provide clearance to allow the film sleeve to fold around the closure flaps 40 and 46 without tearing. It should also be understood that the top closure flaps 40 and 46 could be made more rectangular in shape by providing more sharply beveled edges on the dust flaps 53 and 55, as an alternate way of providing clearance for the film material. Or, a combination of less sharply beveled edges 42 and 48 with beveled edges on the dust flaps could be utilized to accommodate the film.

It should also be understood that the container could be shipped originally in a configuration having a non-gusseted fin seal.

Figure 9:
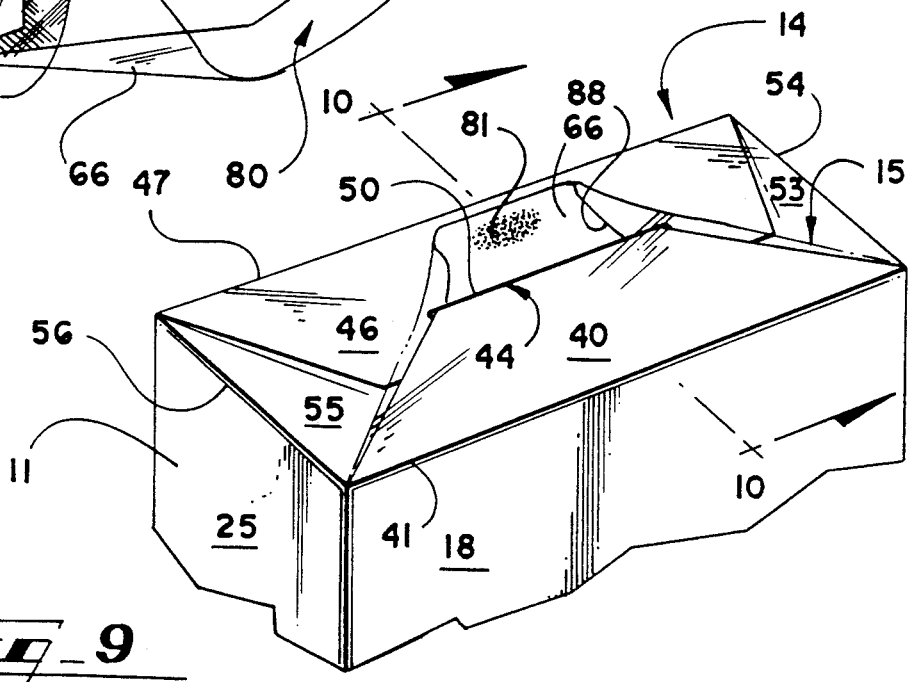
FIG. 9 is a top pictorial view of the container of FIG. 1 in a preferred alternate closed configuration.
Figure 10:
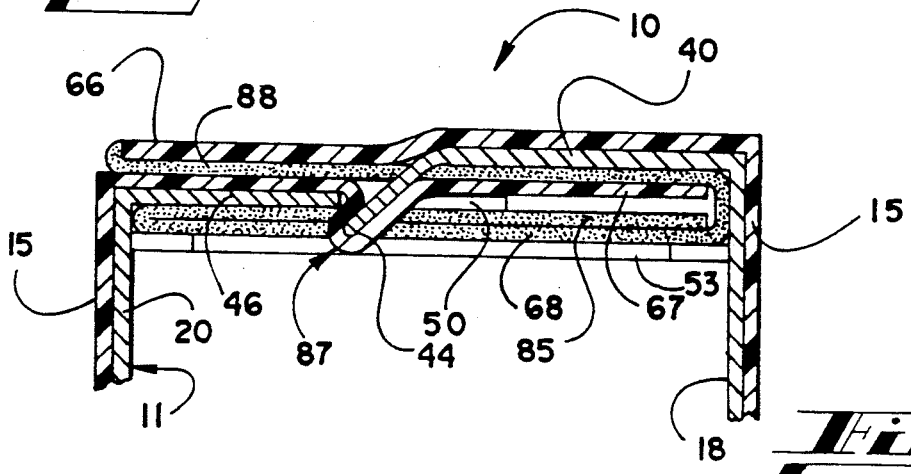
FIG. 10 is a vertical cross section view of the configuration of FIG. 9, taken along line 10—10 of FIG. 9.

A second, preferred embodiment of the top closure 14 of the container 10 is shown in FIGS. 9 and 10. As with the first embodiment described above, when the consumer desires to reclose the container 10, the dust flaps 53 and 55 and the upwardly extending side portions 68 and 69 of the film sleeve are folded together over the top of the container 10, automatically gusseting the film 15. However, the closure flap 46 and associated film portion 67 are then folded flat onto the dust flaps, with the film portion 67 lying across the top opening, with the film covering the lock opening 50. Then the flap 40 and its associated film portion 66 are folded downwardly. The tuck tab 44 is pressed into the film portion 67, deforming it into the lock opening, as shown in FIG. 10. Finally the tuck tab 44 with the film wrapped around it as indicated at 87 in FIG. 10 locks under the flap 46 within the lock opening 50.

Referring to FIG. 10, it will be seen that the closure of this embodiment provides a good air barrier across the top closure of the reclosed container. Above the dust flaps 53 and 55, the side film portions 68 and 69 lie along the dust flaps and a second layer 85 is folded onto the layer 68 or 69 beneath the closure flap 46. The layer 85 connects into the film portion 67 along the angled edges 48. The film portion 67 extends essentially all the way across the top opening to the front panel 18 in the central area between the dust flaps and is held down by the flap 40 and the inserted tuck tab 44. Beneath the angled edge portions of the flap 40, a layer of film 88 is sandwiched between the flap 40 and the film portion 67, while the film portion 66 covers the flap 40 and connects into the layer 88 along the angled edges 42. Optionally, cohesive may be applied to the inner surface of the film portion 66 and to the outer surface of the film portion 67 adjacent to the score 47 to form a releasable bond 81.

In connection with both embodiments described, the extending film portions 66, 67, 68, and 69 extend from the scores 41, 47, 54, and 56 by a distance approximately equal to the depth of the container, that is, the length of the scores 54 and 56.

It should be understood the the terms "top", "bottom", and "side" are used herein only relatively to provide a frame of reference, and are not limiting as to orientation of the parts of the container. Furthermore, the term "seal" is used herein broadly to include barriers which retard air circulation as well as airtight or moistureproof barriers.

From the foregoing description of a preferred embodiment of the present invention, it will be seen that the container 10 provides protection against crushing for perishable, fragile products, is easy to load rapidly, uses the interior space more efficiently, protects the exterior of the box portion, does not require dual sealing films to protect both the contents and the box exterior, and automatically reseals at the same time as the closure flaps are being secured. The container may be opened in a manner which provides a funnel-like area to facilitate pouring contents from the container.

While this invention has been described with particular reference to a preferred embodiment, it should be under stood that variations and modifications may be made without departing from the spirit and scope of the invention as defined in the appended claims.

I claim:

1. A resealing container, comprising:

a sleeve wall portion defining a top opening;

a plurality of closure flaps foldably connected to said sleeve wall portion at said top opening;

said closure flaps enclosing said top opening when folded across said top opening;

means for releasably securing said closure flaps together;

a flexible film extending from said sleeve wall portion and surrounding said top opening, portions of said film being attached to and movable with said closure flaps;

said portions of said film engaging each other outside said flaps so as to seal said top opening when said securing means is securing said closure flaps together upon reclosure of said container.

2. The container of claim 1, wherein said closure flaps comprise first and second closure flaps which overlap when folded across said top opening.

3. The container of claim 2, wherein said engaging portions of said film are pinched between said overlapping closure flaps.

4. The container of claim 3, wherein non-attached portions of said film extending between said closure flaps are tucked under and between said closure flaps when said securing means is securing said second closure flap to said first closure flap upon reclosure of said container.

5. The container of claim 2, wherein said securing means comprises a lock opening defined in said first closure flap and a tuck tab extending from an edge of said second closure flap and positioned to be inserted into said lock opening.

6. The container of claim 5, wherein said film is attached to said first closure flap between said lock opening and said sleeve wall portion, and to said second closure flap between said tuck tab and said sleeve wall portion.

7. The container of claim 5, wherein, upon reclosure of said container, said film extends across said lock opening and said tuck tab deforms said film into said lock opening.

8. The container of claim 1, further comprising a pair of dust flaps foldably attached to said sleeve wall portion, positioned opposite one another between said closure flaps.

9. The container of claim 1, wherein said portions of said film are sealed together prior to initial opening of said container.

10. The container of claim 1, wherein said portions of said film engaging each other carry cohesive which adheres said portions of said film together.

11. The container of claim 1, wherein said portions of said film engaging each other carry pressure sensitive adhesive which adheres said portions of said film together.

12. A method for sealing and resealing a container having a sleeve wall portion defining a top opening and closure flaps connected to said sleeve wall portion at said top opening, comprising the steps of:

attaching a flexible film to an exterior surface of said sleeve wall so as to extend from said sleeve wall portion and surround said top opening;

attaching said film to said closure flaps at selected locations with portions of said film extending from said locations away from said closure flaps;

sealing said film portions to enclose said top opening;

opening said sealed film portions and said closure flaps; and reclosing said closure flaps so as to bring said extending portions of said film into engagement with one another.

* * * * *